US005683000A

United States Patent [19]

Low

[11] Patent Number: 5,683,000

[45] Date of Patent: Nov. 4, 1997

[54] SORTING APPARATUS

[75] Inventor: John Menzies Low, Hertfordshire, United Kingdom

[73] Assignee: Sortex Limited, London, United Kingdom

[21] Appl. No.: 437,862

[22] Filed: May 9, 1995

[30] Foreign Application Priority Data

May 11, 1994 [EP] European Pat. Off. ..... 94303394

[51] Int. Cl.[6] ..... B07C 5/342

[52] U.S. Cl. ..... 209/585; 209/639

[58] Field of Search ..... 209/580, 585, 209/587, 639, 644

[56] References Cited

U.S. PATENT DOCUMENTS 3,197,647 7/1965 Fraenkel ..... 209/585 X 3,545,610 12/1970 Kelly et al. ..... 209/585 X 4,634,881 1/1987 Billion ..... 209/585 X

FOREIGN PATENT DOCUMENTS 2198525 6/1988 United Kingdom .

*Primary Examiner*—F. J. Bartuska

*Attorney, Agent, or Firm*—Burns, Doane, Swecker and Mathis

[57] ABSTRACT

A sorting apparatus for sorting material into desired and undesired pieces or portions includes a moving reflective surface such as a rotating cylindrical drum which is interposed between an illuminated background and a viewing system so that the background is indirectly viewed via the reflective surface. Any liquid or other debris from the product spills onto the reflective surface, rather than the background and is then moved away to be cleaned off. Thus, the viewed optical characteristics of the background remain constant and periodic cleaning of the background is not required.

16 Claims, 3 Drawing Sheets

SORTING APPARATUS

BACKGROUND OF THE INVENTION

This invention relates to sorting apparatus. In particular, it relates to apparatus for sorting objects by their color and for effecting relative separation between desired and undesired objects according to their color.

In particular, but not exclusively, the invention relates to apparatus for sorting organic matter such as vegetables or fruit.

DESCRIPTION OF THE PRIOR ART

It is known to sort small items such as fruit or vegetables by passing a stream of such articles across a viewing system where each article in turn may be viewed against a desired background. The background is set to have a predetermined color which is usually equivalent to the average color of the articles being inspected, and any objects which deviate from a predetermined color are caused to be rejected from the stream by an ejection means. This ejection means generally uses jets of pressurised air although mechanical means such as paddles, etc, are used. The objects to be sorted may be directed into a stream by the use of chutes or conveyors.

The background against which the objects are viewed is generally illuminated and the precise optical characteristics of the background are often variable. Often, the background is set so that desired objects present the same degree of reflectivity, color, luminance, or other optical parameter to a viewing sensor as the background. In this case, once the optical sensor detects a difference it assumes that an undesired object is present. It is clearly important that the optical characteristics of the background remain constant.

Systems of this type work very well with relatively hard objects such as rice, beans or peas for example. However, when the systems are used with relatively soft matter, in particular with fruit or vegetables, the problem arises that these objects tend to pulp or release liquid when manipulated or ejected. The released pulp, puree or other liquid may tend to find its way under some circumstances, to either the light source which illuminates the articles for viewing or, more commonly, to the background. Clearly, any matter, including particles of produce, waste and water droplets on the background will tend to alter its optical characteristics and thus an optical sensor will incorrectly record an undesired object when one is not present. It is of course possible to utilise wiping arrangements which periodically wipe a light or a background but the wiper itself may cause an incorrect reading to be made by the optical sensors. Alternatively, the apparatus is required to be periodically stopped in order for cleaning to take place, which is inconvenient and takes time.

It should be noted that terms such as "optical" and "light" in the present specification embrace not only radiation in the visible spectrum but also that in the infrared and ultra-violet spectra.

An object of the present invention is to provide an improved apparatus for sorting desired from undesired objects.

SUMMARY OF THE INVENTION

According to the present invention there is provided apparatus for sorting material into desired and undesired pieces or portions according to their optical characteristics, comprising viewing means for viewing the material against a background, and characterised by a reflective surface interposed in the optical path between the viewing means and the background and/or between the viewing means and the material, and means for imparting motion to the reflective surface in such a manner that its reflection characteristics are substantially unaffected by its motion.

In a preferred embodiment, the reflective surface is an axially rotated reflecting cylinder or drum which is positioned to reflect light from an illuminated background to a viewing means.

The effect of the present invention is that the reflective surface is situated in a position where any product, liquid or pulped matter from products tend to fall upon the surface, rather than upon the illuminated background. Since the reflective surface is in constant movement, any particles dropped on that surface immediately move out of the optical path so that a new 'clean' part of the optical surface is imposed in the path. The part of the reflective surface moved out of the way may then be cleaned by wiping means, air knifes or other means. Furthermore, the reflecting surface may be moved so fast that any objects falling upon it are thrown off the surface by centripetal forces.

Instead of a rotating cylinder, the reflecting surface may comprise other reflective means, such as an endless reflective belt, a planar face of which is interposed between the material and the illuminated background. The belt may be moved on its own path either in a direction generally parallel to the direction of travel of the material or perpendicularly or at any other angle thereto.

The reflecting surface is preferably of a polished metal, but can be of other material, such as coated glass.

According to the present invention in a second aspect, there is provided a method of sorting material into desired and undesired pieces or portions comprising viewing the material against a background and separating desired from undesired pieces or portions according to a color relationship between them and the background, characterised in that the background and/or the material is viewed indirectly via a reflecting means which is in motion in such a manner that its reflection characteristics are substantially unaffected by its motion.

DESCRIPTION OF THE DRAWINGS

Embodiments of the invention will now be described, by way of example only, with reference to the accompanying drawings, in which.

DESCRIPTION OF THE PREFERRED EMBODIMENTS OF THE INVENTION

Figure 1:
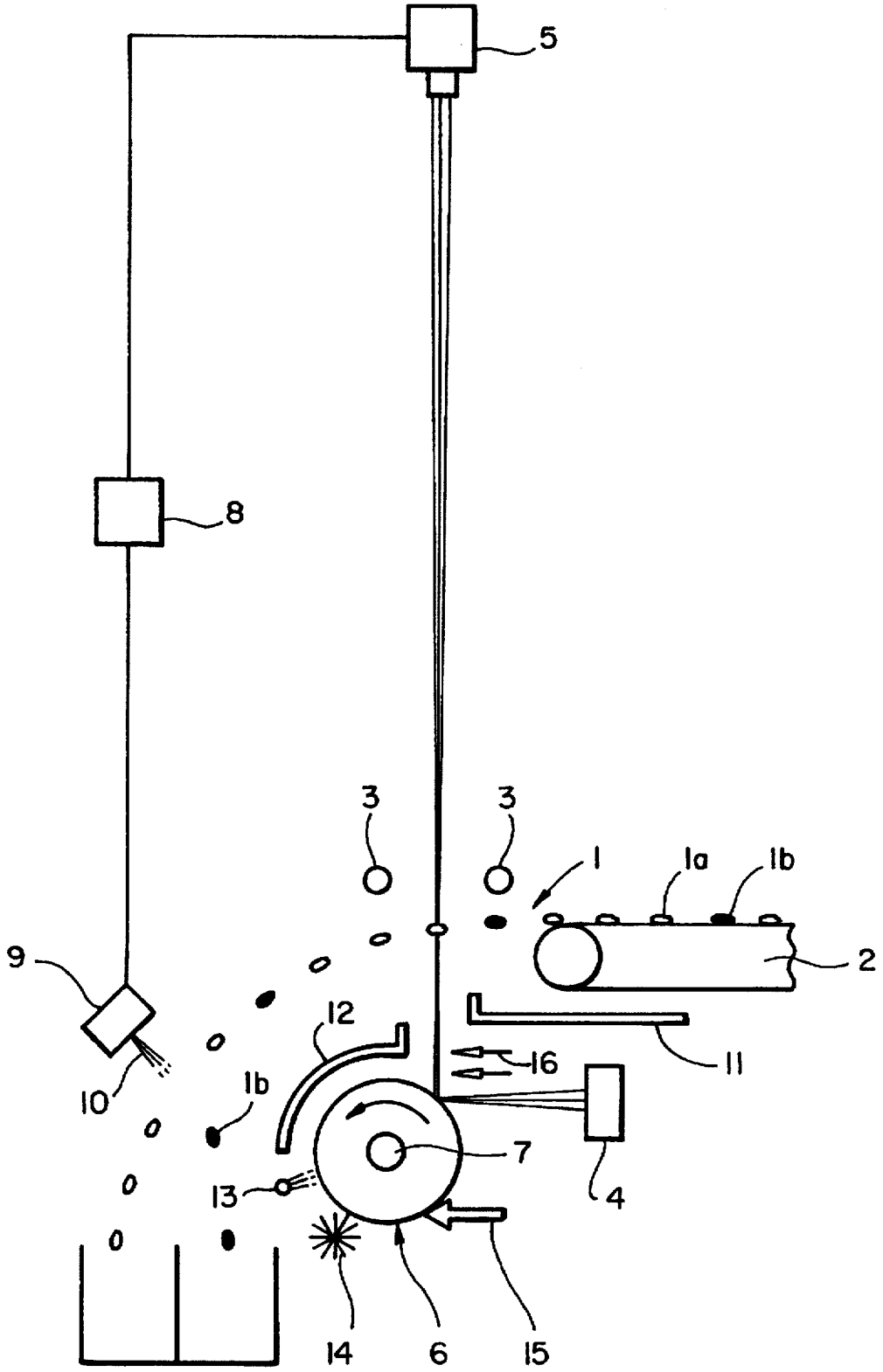
FIG. 1 shows part of an apparatus for sorting objects into desired and undesired pieces or portions.

Referring to FIG. 1, an apparatus is shown which is adapted for sorting objects such as diced carrots for example. Many other objects may be sorted by an apparatus as shown in the figure, which objects need not necessarily be organic ones.

A stream of objects 1 is imparted onto a conveyor 2. The objects comprise desired ones 1*a* and undesired ones 1*b*. In the case of diced carrots for example, the desired objects may be pieces of a specific orange color whereas the undesired pieces may be dark or green for example. The objects are imparted onto the conveyor in such a way that by the time they reach the end of the conveyor they are travelling at the same speed and direction as the conveyor. The conveyor travels relatively fast so that at the end of the conveyor the objects 1 are thrown forward in a stream under the effects of their momentum and gravity. Whilst in the air, the objects are viewed against a background. In prior art systems, the background is placed directly behind the path of the objects and a camera views either the background or an interposed object. The objects are illuminated by one or more light sources 3.

The objects may form a single row along the conveyor or may be spaced in rows or spread randomly over its surface along its width if a relatively wide conveyor is used.

In the present invention, the background 4 is positioned so that it is viewed indirectly by a camera 5. This may be a scanning type camera or any other type of camera or optical sensor or sensor array, such as a photocell, photomultiplier, CCD, laser or other electrooptical means. The background 4, which may be self illuminated or illuminated by light reflecting off it from an additional light source (not shown), emits light onto a moving reflector 6. In the embodiment shown in FIG. 1, reflector 6 is a drum or cylinder made of a suitable reflecting material such as a polished metal. The drum may be a solid cylinder or may be hollow. The drum may be of stainless steel for example. The drum is positioned as shown such that its axis lies perpendicular to the direction of travel of the pieces 1 and is rotated at high speed by a motor 7. This will generally (but not necessarily) be independent of the motor imparting movement to conveyor 2. Indeed, the drum will generally be driven at a much faster rate (typically over three hundred, preferably over one thousand revolutions per minute) than the conveyor. These speeds enable material falling onto the drum to be thrown off by centripetal forces. The drum 6 is positioned such that light emitted from background 4 is reflected off drum 6 at a desired angle into the viewing camera 5. Camera 5 is connected to a control system 8 which includes means for detecting, in known manner, if an object viewed is a desired or undesired one. If an undesired object is detected, control unit 8 delivers an output to ejector 9 which ejects an undesired object from the stream by a jet of pressurised air 10. The desired articles can then be collected in a separate receptacle from the undesired ones as shown.

The drum is preferably of diameter greater than about 5 cm, since a diameter substantially smaller than this tends to cause adverse dispersion of the light.

Two shields are also provided. A first shield 11 shields the top of the background 4 against matter falling directly from the edge of conveyor 2. A second shield 12 protects the reflector 6 from material rejected from the stream by ejector 9 and reduces the contamination of other optical components by material thrown off reflector 6 by centripetal forces. The precise configuration and need for shields will depend upon the particular physical configuration of a system and shields may not be needed at all in some embodiments. In others, it may be desirable to have additional shields.

It is seen from the figure that any liquid or pulpy debris which falls onto the reflective drum 6 may be substantially removed in the present embodiment by the actions firstly of a water spray 13, a rotary brush 14 and a air knife 15 arranged in sequence around the periphery of the drum. As soon as a piece of debris has fallen upon the drum 6 it is carried away by virtue of the continual movement of the drum. This brings a new, clean, part of the drum into the position shown where light from the background 4 impinges upon it and is reflected to the camera 5. The "dirty" piece of the drum is rotated around to a position where it is washed by the air water spray, subsequently cleaned with the rotary bush and then dried with air knife 15. Thus, the drum is continually cleaned without effecting the image of the background scene at any time. The apparatus can be continuously operated without periodic interruptions for cleaning.

An air curtain 16 may optionally be provided under shield 11 to ensure that any debris is generally moved away from the background 4 and other optical components rather than being allowed to fall backwards onto the background 4.

Figure 2:
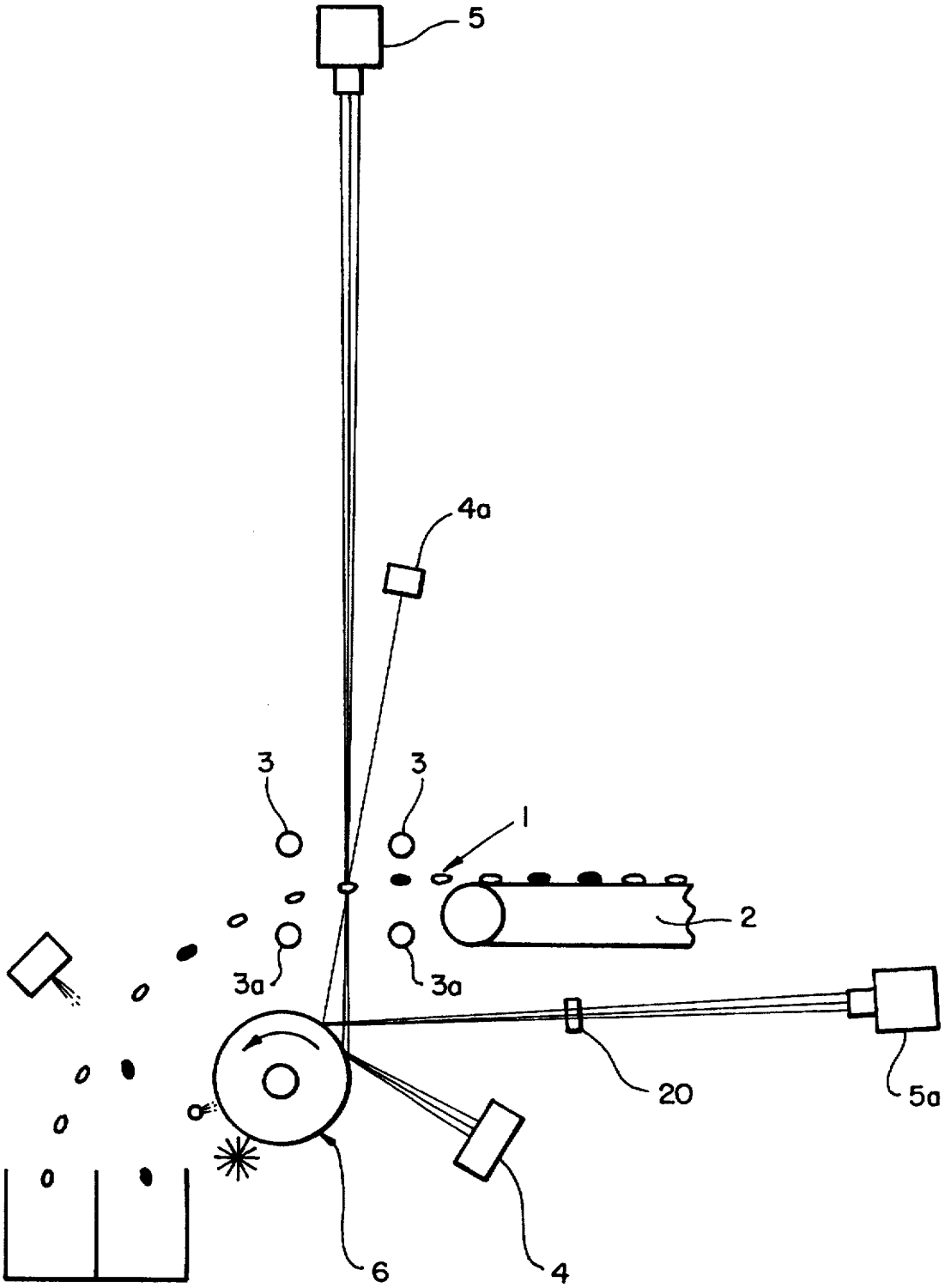
FIG. 2 shows an alternative apparatus in which the material is viewed from two different directions.

FIG. 1 shows a system in which the objects are viewed from only one direction, ie by viewing light reflected off the top of an object from lights 3. Although this is sufficient for many products, for other products it is desirable or necessary to view the products simultaneously from two or more different angles to improve performance. FIG. 2 shows a system in which two viewing systems are used. One system views an object from above as before and the second viewing system views an object from below. Both viewings may occur simultaneously or sequentially. Thus, even if the top of an object appears to be good, viewing it from the bottom may show a small blemish for example that may make the product an undesirable one. The system shown is similar to that of FIG. 1 (with some parts such as the shields removed for clarity) but with the addition of a second viewing system incorporating lights **3*a*, viewing camera 5*a*, a second background 4*a* and a correction lens 20**.

Second background **4*a* lies above the path of the product but slightly off set from the line between the cylinder 6 and first camera 5. The background shines onto cylinder 6 from where the light is reflected through correction lens 20 to the second camera 5*a*. When a product 1 interposes between the background 4*a* and cylinder 6 light is reflected off the product from light sources 3*a* and is again reflected off cylinder 6. Thus, the light from the products is (like the background) indirectly viewed by camera 5*a* whereas in the embodiment of FIG. 1 only the background light is viewed indirectly and the product is viewed directly. Since the product will be of finite size, some of the light reflected off the product from light sources 3*a* will impinge upon cylinder 6 over a range of angles and thus the correction lens 20** (generally a cylindrical lens) or a lens assembly may be necessary to correct for any aberration that occurs.

Figure 3:
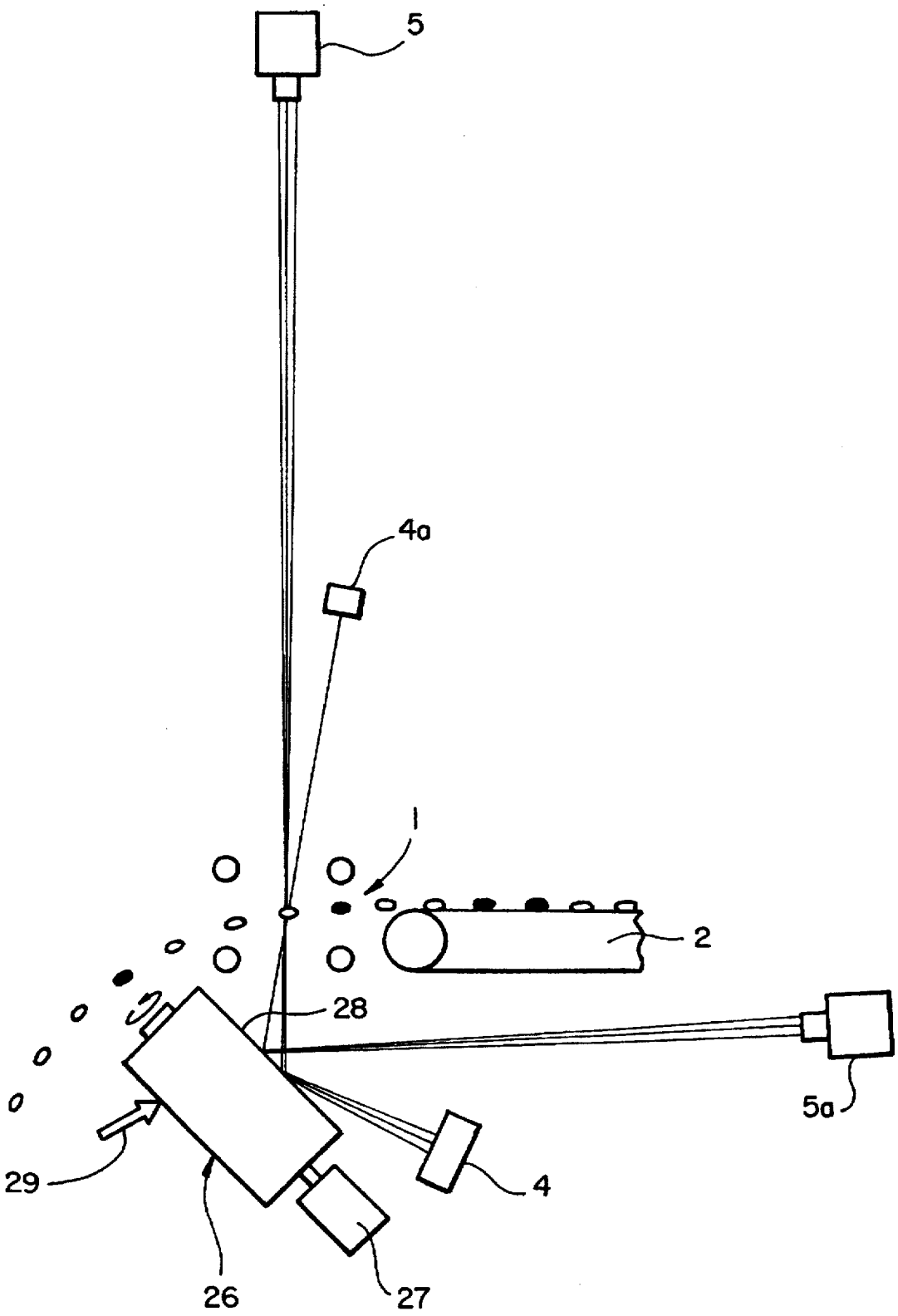
FIG. 3 shows a further alternative apparatus.

Although the use of a reflecting cylinder or drum is often convenient the moving reflector of the present invention need not necessarily be a drum. FIG. 3 shows an embodiment in which the reflector is an endless belt 26 which is continually moved by a motor 27. The belt in the example shown in FIG. 3 presents a flat surface into the plane of the paper, ie perpendicular to the stream of objects on the conveyor. Light from the background 4 and/or light from the stream of objects is reflected off this planar surface 28 in the same manner as light from the cylindrical surface of the cylinder shown in FIGS. 1 and 2. Since the belt is continually moving, debris collected by the belt is continually moved out of the light path and the belt may be cleaned, for example by similar means to those shown in FIGS. 1 and 2. An air knife 29 is also shown to aid in cleaning the belt.

If an endless loop type reflector is provided it need not necessarily be disposed as shown in FIG. 3 but could be disposed in any of a number of different configurations. In one example, the belt may lie with its planar surfaces parallel to those of the conveyor and rotating in the same sense as the conveyor.

Many other types of moving reflector may be provided.

Moving reflectors may be placed in other positions of the apparatus than those shown, and used to cause other illuminated means than the background to be viewed indirectly.

It will be appreciated that sorting systems embodying the present invention may be ones which separate discrete pieces of material (eg diced carrots, potatoes, berries for example) or which remove undesired portions from pieces of material, in which case cutting means may be necessary in association with the ejection means.

The background and/or illumination means may utilise laser light.

I claim:

1. Apparatus for sorting material into desired and undesired pieces or portions according to their optical characteristics, comprising a background, an optical viewing system for viewing the material against the background, a moving reflective surface interposed in the optical path between the viewing system and the background, the moving reflective surface being such that the reflection is substantially unaffected by its motion.

2. Apparatus as claimed in claim 1, wherein the reflective surface is a rotating reflective drum having a longitudinal axis about which it is rotated.

3. Apparatus as claimed in claim 2, wherein the drum is rotated, in use, at a speed which is greater than or equal to about 300 rpm.

4. Apparatus as claimed in claim 2, wherein the diameter of the drum is greater than or equal to about 5 cm.

5. Apparatus as claimed in claim 1, wherein the reflective surface is a moving endless belt.

6. Apparatus as claimed in claim 1 wherein the reflective surface is interposed between the background and the viewing system such that the background is viewed indirectly, via the moving reflective surface.

7. Apparatus as claimed in claim 1, wherein the reflective surface is interposed between the material and a viewing system such that the material is viewed indirectly, via the moving reflective surface.

8. Apparatus as claimed in claim 7, including a correcting lens or lens assembly between the reflective surface and the viewing system.

9. Apparatus as claimed in claim 1, comprising one or more illumination means for illuminating the material.

10. Apparatus as claimed in claim 1, arranged for viewing material from a plurality of angles simultaneously, and including two backgrounds, each being associated with a respective optical viewing system, wherein the moving reflective surface is disposed so that it is commonly interposed between the material and the second viewing system.

11. Apparatus as claimed in claim 1, wherein the material is viewed in flight.

12. A method of sorting material into desired and undesired pieces or portions comprising viewing the material against a background and separating desired from undesired pieces or potions according to a color relationship between them and the background, wherein the background is viewed indirectly via a moving reflecting surface, and wherein the reflection from said reflecting surface is substantially unaffected by its motion.

13. Apparatus as claimed in claim 1, wherein the moving reflective surface is positioned between the material and the background.

14. Apparatus as claimed in claim 1, wherein the moving reflective surface is positioned between the viewing system and the material.

15. Apparatus as claimed in claim 13, comprising a second moving reflective surface positioned between the viewing system and the material.

16. A method as claimed in claim 12, wherein the material is viewed indirectly via said moving reflective surface.

* * * * *